United States Patent [19]

Gaiser

[11] 4,098,506

[45] Jul. 4, 1978

[54] HAND GRIP SLEEVE FOR HAND TOOLS AND THE LIKE

[76] Inventor: Conrad J. Gaiser, P.O. Box 534, Zephyr Cove, Nev. 89448

[21] Appl. No.: 754,444

[22] Filed: Dec. 27, 1976

[51] Int. Cl.[2] ..... A63B 49/08

[52] U.S. Cl. ..... 273/75; 273/81 R; 74/558; 145/61 R; 273/DIG. 8

[58] Field of Search ..... 273/26 B, 29 A, 67 R, 273/72 R, 73 R, 73 J, 75, 81 R, 81 B, 81 D, 81.2–81.6, 162 R, 165, 193 R, 194 R, DIG. 8; 145/61 R, 61 K; 204/11; 43/23; 264/101; 74/551.9, 558, 558.5; 190/57; 16/110 R; 260/2.5 R, 2.5 A, 2.5 D

[56] References Cited

U.S. PATENT DOCUMENTS

| | | | |
|---|---|---|---|
| 1,472,689 | 10/1923 | Skiles | 145/61 R X |
| 2,185,568 | 1/1940 | Rutner | 273/81 R X |
| 3,147,012 | 9/1964 | Sullivan | 273/81.2 X |
| 3,171,820 | 3/1965 | Volz | 260/2.5 |
| 3,475,525 | 10/1969 | Peters | 264/101 |
| 3,500,572 | 3/1970 | Johnson | 273/81 R X |
| 3,549,505 | 12/1970 | Hanusa | 204/11 |
| 3,606,326 | 9/1971 | Sparks et al. | 273/81 R |
| 3,614,100 | 10/1971 | Spitz | 273/75 |
| 3,802,291 | 4/1974 | Young et al. | 273/81 R X |

FOREIGN PATENT DOCUMENTS

| | | | |
|---|---|---|---|
| 1,142,073 | 2/1969 | United Kingdom | 273/75 |

*Primary Examiner*—Richard J. Apley

*Attorney, Agent, or Firm*—Fulwider, Patton, Rieber, Lee & Utecht

[57] ABSTRACT

There is disclosed a removable hand grip that is received over the hand gripping portion of a handle of a tool, particularly of a tennis racket and the like. The hand grip comprises a tubular sleeve of an open-celled, noncapillary, porous material having an uncompressed wall thickness no greater than about 5/16 inch. Most preferably a material of a reticulated structure such as a non-woven fibrous material is used. This material, in contrast with sponge and sponge-like materials has a low water holding capacity, less than about 20 volume percent. Preferably, the hand grip has a high degree of compressibility, typically with a compression resistance at about 80 percent deflection no greater than 1.5 to about 4 pounds per square inch. The low capillary and open-celled structure of the sleeve insures breathing of the sleeve under repeated compression which is adequate to expel most moisture during use. This breathing action is accentuated by the high compressibility of the foam. Since the sleeve is easily removable it can be readily washed for reuse. The ease of compressibility of the sleeve also insures that there is no significant loss in the kinesthetic preception of the tool position by the user, sharply contrasting with prior art hand grips.

7 Claims, 8 Drawing Figures

10
12
14
16
15
22
20

12
4
16
4
20
18

10
12
14
20
16
24
26

15
20
14

36
20
26
20
14

26

20
38
40
20

HAND GRIP SLEEVE FOR HAND TOOLS AND THE LIKE

BACKGROUND OF THE INVENTION

1. Field of the Invention

This invention relates to a removable hand grip for a hand tool and, in particular, to a removable grip for tennis rackets and the like.

2. Brief Description of the Prior Art

A large number of devices such as sleeves, tapes and the like have been designed to provide a non-slipping, gripping surface for handles of hand tools and racket handles which often become coated with perspiration and oil. Popular among such devices are adhesive tapes of foam material that often have a rough exterior surface to facilitate gripping. Adhesive tapes, however, cannot be readily removed and often become clogged or saturated with perspiration and oil from the user.

Another device comprises a removable sleeve of a porous material such as terry cloth or sponge material shown in U.S. Pat. No. 3,614,100. While the latter device can be removed and washed and thereby does not suffer the disadvantage of becoming saturated with perspiration and the like, this device is bulky and is not formed of readily compressible material. Consequently, the non-circular or asymmetric shape of a handle is obscured by the removable sleeve and the desired kinesthetic preception of the tool position in the user's hand is greatly inhibited or lost. Another disadvantage of sleeve of a material such as terry cloth or sponge is the high water retention of the latter materials. Under strenuous use, such as during a competitive atheletic contest, these materials can become water soaked, increasing greatly their weight (which tends to unbalance the tool) and decreasing their efficiency by preventing air circulation through the material.

Some attempts to retain a kinesthetic preception with a sleeve grip has been attempted by molding grooves into the exterior surfaces of a molded rubber or plastic sleeve. These sleeves, however, are permanently affixed to the tool handle and do not accomodate for different tool positions in a user's hand or different preferences of tool positions by various users.

BRIEF DESCRIPTION OF THE INVENTION

This invention comprises a removable hand grip for handles of tools, and in particular, for tennis rackets and the like. The hand grip comprises a sleeve of open-cell material and is loosely received over the gripping surface of the tool handle. The material is at least 50 percent open-celled, preferably fully open-celled, and most preferably of a reticulated structure. The reticulated structure is, basically, a non-woven fibrous, compressible material. It can be obtained by heat treatment of open-celled, cellular plastic foam or can be obtained by the consolidation of a mat of non-woven fibers with a suitable adhesive. The material used has a low density, typically from 0.2 to about 6 pounds per cubic foot and has a very high degree of compressibility; the resistance to compression is preferably no greater than about 1.5 to about 40 psi at 80 percent deflection. The latter property of the material insures that the kinesthetic preception of tool position in a user's hand is not significantly impaired since the normal grasping force of the user is sufficient to preceive, through the compressed thickness of the hand grip, the handle contour or assymetry normally provided by the manufacturer for such purpose. The open-celled, non-capillary structure of the foam and its low resistance to compressibility also insures that there is ventilation of the hand grip during use; the repititous grasping action during use functioning to pump air through the structure, expelling water vapor and the like.

BRIEF DESCRIPTION OF THE DRAWINGS

The invention will be described with reference to the illustrations of which.

DESCRIPTION OF THE PREFERRED EMBODIMENTS

Figures 1, 2, 3, 4, 5, 6, 7, 8:
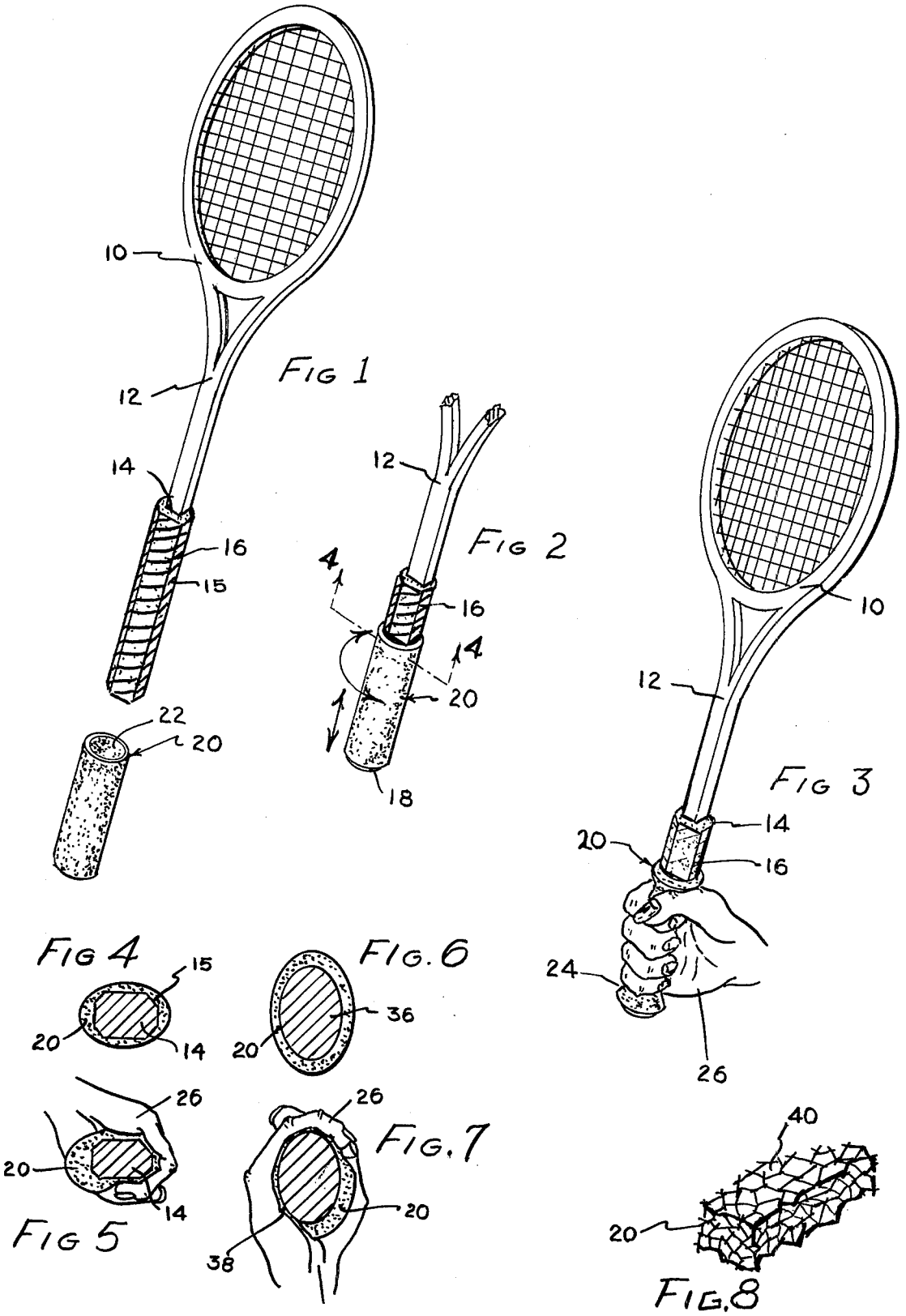
FIGS. 1–3 illustrate the application and use of the sleeve grip of the invention on a tennis racket handle.
FIGS. 4 and 5 are sectional views through a portion of a typical racket handle.
FIG. 6 and 7 are sectional views through a typical assymetric cross-section handle with the hand grip of the invention.
FIG. 8 is an enlarged view of a portion of the most preferred material used for the sleeve.

The application and use of the hand grip of the invention is illustrated in FIGS. 1–3 as applied to a hand tool such as a tennis racket 10. The racket has a handle 12 with a hand gripping portion 14 which is commonly covered with a material having a rough surface to enhance grasping of the tool. The illustrated material is a plastic tape 16 which is secured by a suitable adhesive or binder to the handle 14.

The handle 14 is of a non-circular cross-section and as illustrated has a plurality of flats 15 permitting kinesthetic preception of the orientation of the tool in the user's hand.

The hand grip 20 of the invention comprises a generally tubular sleeve formed of a material having at least 50 percent and, preferably, 100 percent open cells. Most preferably the material is of a reticulated, three-dimensional structure. This structure is, basically, a non-woven fibrous structure which can be obtained by consolidation of a loose non-woven mat of randomly oriented fibers or by reticulation treatment of an open-celled, cellular plastic foam. The sleeve has an inner surface 22 of sufficient diameter so that the hand grip 20 can be slipped over handle 14 as shown in FIG. 2. The hand grip 20 can loosely fit over handle 14 such that the hand grip 20 ca be freely moved as shown by the arrow-headed lines 17 and 19 when the tool is not in use. Since the preferred material employed for the hand grip 20 is at least slightly elastomeric, the hand grip 20 can expand to accommodate and fit handles of varied diameter.

The flexible, open-celled material for the hand grip should have a low capillary structure as reflected by a low water holding capacity. Preferably the maximum amount of water retained by the material should be no greater than about 20 volume percent and, most preferably, no greater than about 10 volume percent. The limited water holding capacity insures that the material readily "breathes" in use and moisture is expelled rather than retained, thereby retaining the natural balance of the tool and firmness in grip of the hand grip.

The material can be obtained by various manufacturing methods. One method is to consolidate a loose mat of randomly oriented fibers, such as polyester fibers, with an adhesive such as an aqueous polyvinylacetate or synthetic rubber latex. The most preferred material is reticulated, open-celled, plastic foam, preferably polyurethane foam. This material can be prepared by a post formation heat treatment to rupture cell walls of the foam, leaving a reticulated or skeleton structure which, closely resembles the aforementioned non-woven fibrous mat structure.

A variety of open-celled, cellular plastic foams can also be employed for hand grip 20, provided that they have the aforementioned ease of compressibility and low water holding capacity. A preferred class of foams are flexible, open-celled, cellular polyurethane foams. There are two general types of foam that are commonly available; these are ether-base and ester-base polyurethane foams. Of these, the ester-base polyurethane foams are most preferred for use as the open-celled or reticulated materials because of their high resistance to oils, moistures and solvents. Generally, the flexible, open-celled, cellular plastic foam or reticulated foam has a low density, e.g., from about 0.1 to about 6 pounds per cubic foot.

As shown in FIG. 3, the hand grip 20 has a very substantial compressibility such that when grasped in the hand 26 of a user, the foam plastic hand grip 20 readily deforms and assumes the contour of handle 14 to permit the user to sense flat surfaces 15 or any other assymetry of the handle provided by the tool or racket manufacturer to impart the desired kinesthetic preception of the tool position.

The compressibility of the hand grip 20 is better illustrated in FIGS. 4 and 5 which are sectional views of FIGS. 2 and 3, respectively. As shown in FIG. 4, the hand grip 20 assumes, in its uncompressed state, the general oblong configuration of handle 14, however, the exterior surface of the hand grip is generally curvalinear because of the natural elasticity and resiliency of the material from which the hand grip 20 is formed. This masks or obscures flats 15.

When the tool is grasped, as shown in FIG. 5, by a user's hand 26, the hand grip 20 readily deforms to assume, very closely, the contour of handle 14. The hand grip 20 in its compressed state closely conforms to the contour of handle 14 and provides a thin layer 30 of minimal thickness. This characteristic assures that the user retains all the kinesthetic preception of tool position achieved by the manufacturer's design of handle 14.

The flexible, open-celled, material employed for hand grip 20 should, preferably, be readily compressible and be capable of substantial deflection under minor compressive loading. The ease of compressibility of the aforementioned materials can be expressed by the amount of force required to compress the materials to a designated deflection. In the instant invention materials having compressive loadings from 1.4 to about 4.0 pounds per square inch at 80 percent deflection are suitable for use in the invention.

FIGS. 6 and 7 illustrate the application of the invention with another handle configuration. In this configuration, the handle 36 is of generally elliptical cross-section, typical of hand tools such as hammers, axes and the like. The hand grip 20 of the invention can be placed over this handle and, in its uncompressed state, will have the contour and thickness shown in FIG. 6. When the handle is grasped by a user's hand 26 and normal gripping tension is applied, hand grip 20 readily compresses to the wall thickness 38 shown in FIG. 7. At this condition, the hand grip does not significantly increase the overall thickness of the handle 36 and grip 20 and users unaccustomed to the hand grip 20 readily adapt to its use.

FIG. 8 is a view of a piece of the most preferred reticulated foam material. The material is formed with a three-dimensional reticulated structure of open polygons 40 which result from the collapse of cell walls of the cellular plastic, leaving a skelton, reticulated structure. The structure closely resembles a non-woven mat of randomly oriented, short fibers distally interconnected to form the reticulated structure. The structure is sufficiently open that thicknesses up to about 5/16inch will transmit light.

The reticulated polyurethane foam material also has a very high tensile strength compared to other flexible foam materials. Typically the material has a tensile strength from 35 to about 50 psi. This high tensile strength is of substantial benefit snce it insures that the hand grip does not readily tear when applied to a handle or when in use.

The hand grip of the invention has characteristics and achieves results not accomplished by any prior art device. The hand grip is formed of inexpensive and readily available materials. Since the material is highly compressible, there is no significant loss of kinesthetic preception of the tool position when grasped in a user's hand. The porous structure of the material also provides a coarse or rough exterior surface which can be readily grasped by a user without any discomfort and a similar interior surface for maximum frictional engagement with the tool handle thereby insuring against unintentional rotation of the handle in the user's hand without adhesively attaching the hand grip to the tool handle.

The non-capillary, porous, open-celled structure of the material also insures a very desirable ventilation in use. The material undergoes repeated compression and expansion, experiencing approximately an eight fold volumetric change as the user's grip is relaxed and tightened during use. This imparts a pumping action to the hand grip, forcefully circulating air through the hand grip and evaporating moisture and oil. As a consequence, the hand grip can be employed on a tool such as a tennis racket handle and the like over prolonged periods of strenuous exercise without causing any discomfort or tendency to slip.

Since the hand grip fits the tool handle loosely, it can be easily removed and washed to rid the handle of soil and perspiration residues such as salt and the like, thereby maintaining a sanitary condition. Since the sleeve fits the handle loosely, the user can readily rotate the tool handle in the hand grip sleeve when desired to turn the hand grip to a comfortable position and offset any short term compression set that the material may take in use.

Finally, the extremely low density of the material employed for manufacture of the hand grip insures that there will be minimal effect of the balance of the tool. Typically a hand grip for use in accordance with the invention weighs less than about 0.25 ounce and this weight is so minimal that it does not disturb the natural balance of the tool.

The invention has been described with reference to the illustrated and presently preferred embodiments thereof. It is not intended that the invention be unduly limited by this description of the illustrated embodiment. Instead, it is intended that the invention be defined by the means, and their obvious equivalents set forth in the following claims.

What is claimed is:

1. A manual tool having a handle with a hand grip for grasping by a user and a cover member received over said hand grip, having a wall thickness no greater than about 0.3 inch and loosely received over said hand grip for direct hand contact by the user and formed of at least 50 percent open-celled, non-capillary, porous, elastic and resilient material having a density from 0.1 to about 6 pounds per cubic foot and a water holding capacity no greater than about 20 volume percent.

2. The tool of claim 1 wherein said material is reticulated open-celled plastic foam having an entirely open-celled structure with a water holding capacity no greater than 10 volume percent.

3. The tool of claim 1 wherein said plastic foam is a polyurethane foam.

4. The tool of claim 3 wherein said plastic foam is an ester-base polyurethane.

5. The tool of claim 1 which comprises a racket having an elongated handle and a hand gripping section which receives said hand grip.

6. The tool of claim 1 having a non-circular cross-section for kinesthetic sensing of the tool orientation.

7. The tool of claim 6 wherein said porous material has a compressive resistance at 80 percent deflection no greater than about 4 pounds per square inch.

* * * * *